US008496042B1

(12) United States Patent
Motosko et al.

(10) Patent No.: US 8,496,042 B1
(45) Date of Patent: Jul. 30, 2013

(54) ACCORDION-TYPE STORM SHUTTER HAVING REINFORCED HINGE MEMBER FOR STORM SLATS

(76) Inventors: Stephen J. Motosko, Sarasota, FL (US); Stephen Motosko, III, Sarasota, FL (US)

( * ) Notice: Subject to any disclaimer, the term of this patent is extended or adjusted under 35 U.S.C. 154(b) by 81 days.

(21) Appl. No.: 12/579,150

(22) Filed: Oct. 14, 2009

(51) Int. Cl.

| | |
|---|---|
| ***E05D 15/00*** | (2006.01) |
| ***E06B 3/48*** | (2006.01) |
| ***E06B 3/96*** | (2006.01) |
| ***E06B 7/086*** | (2006.01) |
| ***E06B 3/12*** | (2006.01) |

(52) U.S. Cl.
USPC ..... 160/187; 160/229.1; 160/236

(58) Field of Classification Search
USPC ..... 160/183, 206, 207, 213, 233, 235
See application file for complete search history.

(56) References Cited

U.S. PATENT DOCUMENTS

| | | | | |
|---|---|---|---|---|
| 2,641,018 | A * | 6/1953 | Snyder | 16/356 |
| 4,345,635 | A | 8/1982 | Solomon | |
| 5,456,305 | A | 10/1995 | Snarli | |
| 5,740,850 | A * | 4/1998 | Hoffman | 160/183 |
| 6,546,681 | B1 | 4/2003 | Trundle | |
| 6,615,896 | B1 * | 9/2003 | Andalia | 160/183 |
| 7,121,316 | B2 * | 10/2006 | Biggers | 160/183 |
| 2006/0027345 | A1 * | 2/2006 | Briscoe et al. | 160/213 |

* cited by examiner

*Primary Examiner* — Katherine Mitchell
*Assistant Examiner* — Jeremy Ramsey
(74) *Attorney, Agent, or Firm* — Gifford, Krass, Sprinkle, Anderson & Citkowski, P.C.

(57) ABSTRACT

An accordion-type shutter assembly including a plurality of elongated vertically extending corrugated or flat shutter slats hingedly held together in an edge-to-edge arrangement for limited pivotal movement between adjacent slats between the assembly being open and closed. The shutter assembly is used to protect a window or door from flying object damage and building intrusion caused by storm or hurricane. The female hinge half along one of the edges of each slat has lengthwise extending rib reinforcements for greater impact resistance to better withstand the impact of airborne flying objects produced during storms and hurricanes.

6 Claims, 5 Drawing Sheets

ACCORDION-TYPE STORM SHUTTER HAVING REINFORCED HINGE MEMBER FOR STORM SLATS

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to accordion-type hurricane storm shutters which, when deployed, protect windows and doors from flying object impact during storms and hurricanes, and more particularly to such a storm shutter having corrugated or flat storm slats with ribbed reinforced hinge members which greatly increase the storm shutter's ability to withstand high velocity airborne object impact during a hurricane and building code testing.

2. Description of Related Art

Accordion-type shutter assemblies and roll-up shutter assemblies have become extremely popular for protecting the windows and doors and thus the interiors of buildings during severe storms and hurricanes. Flying objects, which, when airborne, can exceed well over one hundred miles an hour during a hurricane, are easily able to penetrate through unprotected doors and windows leading to more severe building damage as a result thereof.

The following prior patents are examples of accordion-type shutter assemblies developed to protect the interior of a home or building.

U.S. Pat. No. 4,345,635 to Solomon discloses a rolling protective gate or door for store fronts, building entrances or the like in which vertical rods or links are completely eliminated and in which the gate is not made in open grille form, but which provides a high degree of visibility therethrough when the gate is in the lowered position.

Snarli teaches a rollable or foldable shutter for protecting window areas where all or parts of the shutter are transparent in U.S. Pat. No. 5,456,305.

A combination blade of extruded aluminum and transparent impact plastic such as polycarbonate to protect glass windows and doors is disclosed in U.S. Pat. No. 6,546,681 to Trundle.

Recent building code restrictions have dramatically increased impact strength requirements for doors and windows and devices intended to afford protection from storm and hurricane damage due to wind-driven flying objects. Current hurricane protection must now be stringently tested and qualified for production and code acceptance under test conditions not imagined two decades ago. As a result, not only have the overall impact strength requirements been increased, but the uniqueness of the testing requirements are forcing development of specialized hurricane protection structure to, at least in part, meet specific code testing requirements. The present invention provides corrugated rather than flat accordion-type storm shutter slats which greatly increase the ability of these storm shutters in meeting these new hurricane testing codes by affording a substantially greater resistance to flying object impact when that flying object strikes directly against the center of one of the slats rather than impacting against a stronger knuckle area between shutter slats.

The present invention also provides an improved corrugated or flat shutter for an accordion-type storm shutter assembly with ribbed hinge members for better protecting windows and doors during storms and hurricanes. Moreover, it is submitted that each of the embodiments disclosed in this invention will more than adequately meet current impact test requirements for such accordion shutters as set forth in municipal building codes.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This invention is directed to an accordion-type shutter assembly including a plurality of elongated vertically extending corrugated or flat shutter slats hingedly held together in an edge-to-edge arrangement for limited pivotal movement between adjacent slats between the assembly being open and closed. The shutter assembly is used to protect a window or door from flying object damage and building intrusion caused by storm or hurricane. The female hinge half along one of the edges of each slat has lengthwise extending rib reinforcements for greater impact resistance to better withstand the impact of airborne flying objects produced during storms and hurricanes.

It is therefore an object of this invention to provide an improved accordion-type shutter assembly and shutter slats therefor which substantially increases resistance to flying objects damaging windows and doors and penetrating into a building through the windows which are protected by this invention.

Yet another object of this invention is to provide an improved accordion-type shutter assembly for windows and doors which is easily assemblable and affords the necessary strength and security by these assemblies to meet or exceed building code hurricane testing procedures.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

Exemplary embodiments are illustrated in reference figures of the drawings. It is intended that the embodiments and figures disclosed herein are to be considered to be illustrative rather than limiting.

| List of Components | |
|---|---|
| 10 | storm shutter assembly |
| 12 | window frame |
| 14 | plurality of shutter slats |
| 16 | storm slat |
| 18 | corrugations |
| 20 | female hinge edge |
| 22 | male hinge edge |
| 24 | corrugations peak contact |
| 26 | tab, male |
| 28 | tab, male |
| 30 | cylindrical hinge cavity |
| 32 | open stop surface |
| 34 | open stop surface |
| 36 | rib reinforcement |
| 38 | rib reinforcement |
| 40 | closed stop surface |
| 42 | closed stop surface |
| 44 | tab, female |
| 46 | tab, female |
| 48 | rib reinforcement |
| 50 | rib reinforcement |
| 60 | plurality of shutter slats |
| 62 | flat storm slat |
| 64 | flat panel |

DETAILED DESCRIPTION OF THE INVENTION

Figure 1:
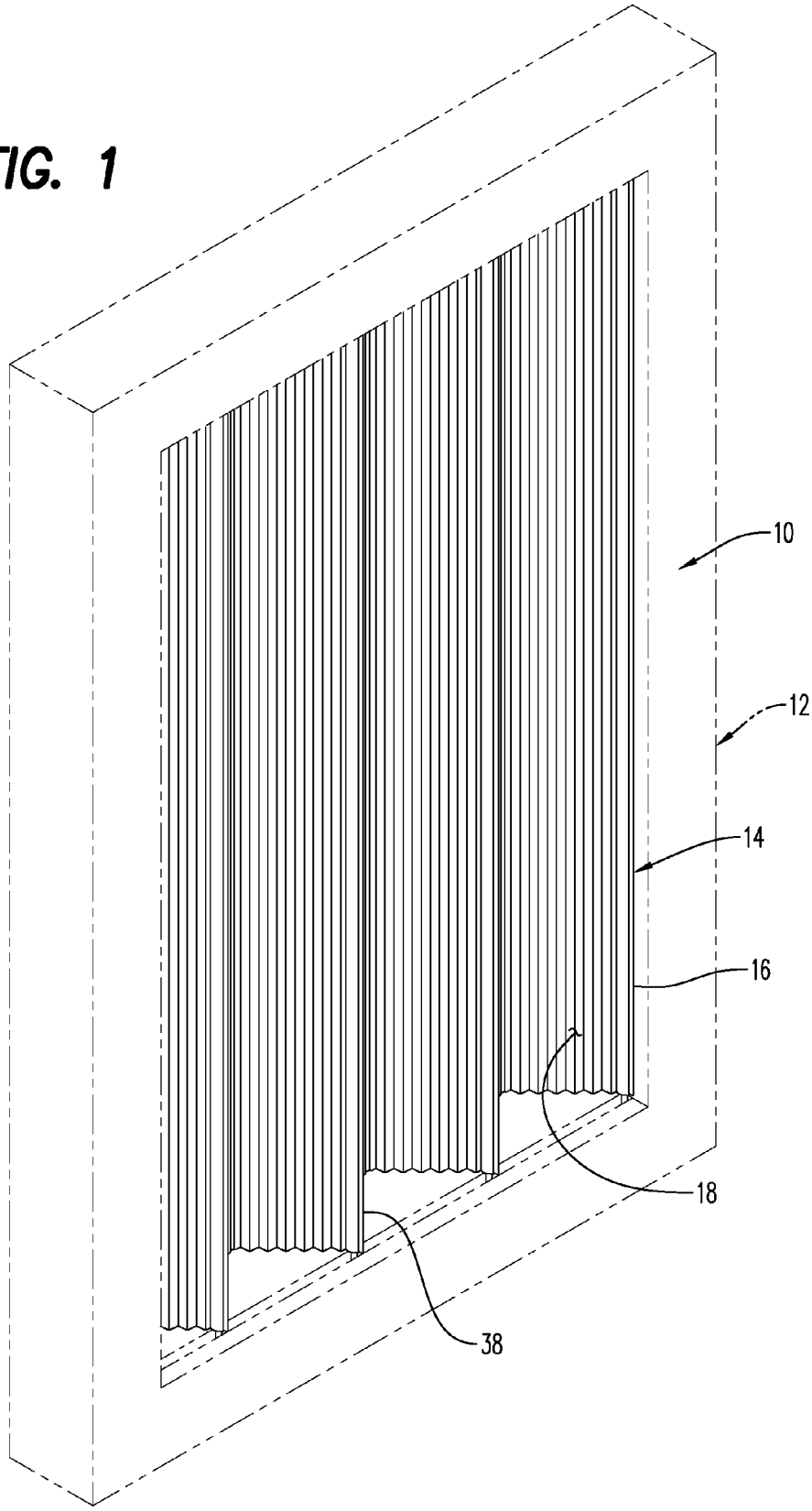
FIG. 1 is a perspective view of a corrugated shutter slat embodiment an accordion shutter assembly of this invention installed into a window frame and shown in the closed configuration.
Figure 2:
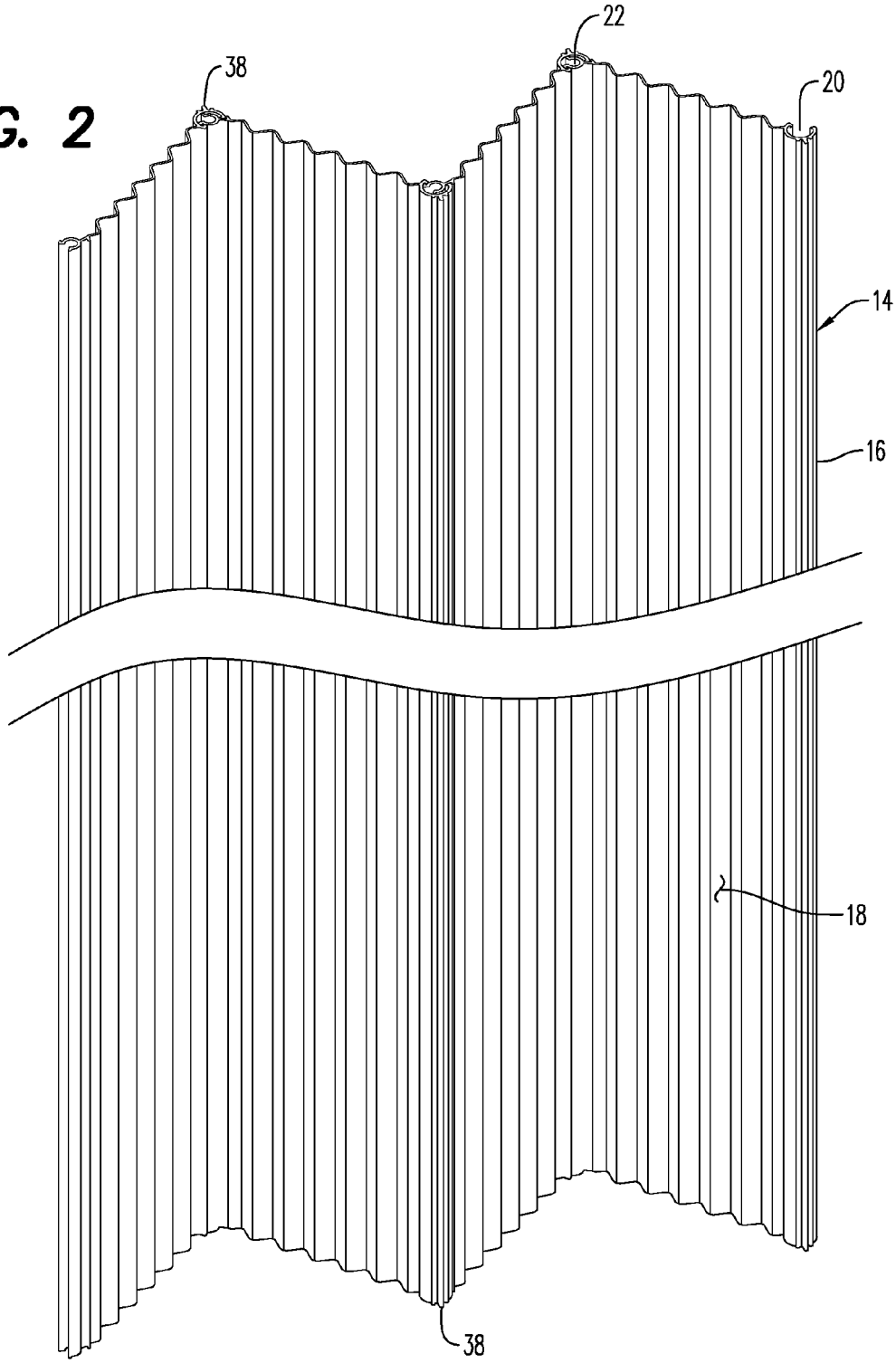
FIG. 2 is a perspective view of a portion of the shutter slats of FIG. 1.

Referring now to the drawings, one embodiment of an accordion-type storm shutter assembly is there shown generally at numeral 10 in conjunction with a window frame 12 in a home or building. The storm shutter assembly 10 includes a plurality of elongated vertically extending shutter slats shown generally at numeral 14, shown in FIGS. 1 to 3 in the open or deployed orientation, and in FIG. 4 in the closed or stored orientation. Each of the storm shutter slats 16 comprising the plurality of storm slats 14 is preferably formed as a unit by extrusion of either aluminum, other suitable metal, or polycarbonate material. Each of the storm slats 14 includes first and second hinge edges 20 and 22 configured to be matably engaged by sliding a male hinge edge 22 of one slat 16 lengthwise into a female hinge edge 20 of the next adjacent slat 16 and so on. Female hinge edge 20 is formed having a cylindrical cavity 30 configured to slidably and pivotally receive the male hinge edge 22 with tabs 26 and 28 which, in cooperation with the female edge 22, defines a hinge connection between each adjacent slat 16.

A main or central portion of each of the storm slats 16 includes spaced corrugations 18 formed as a series of peaks and valleys which add substantial stiffness and impact resistance strength to each slat 16. These corrugations 18 are preferably generally sinusoidal in cross-section and extend along the entire length of each slat 16.

Figure 3:
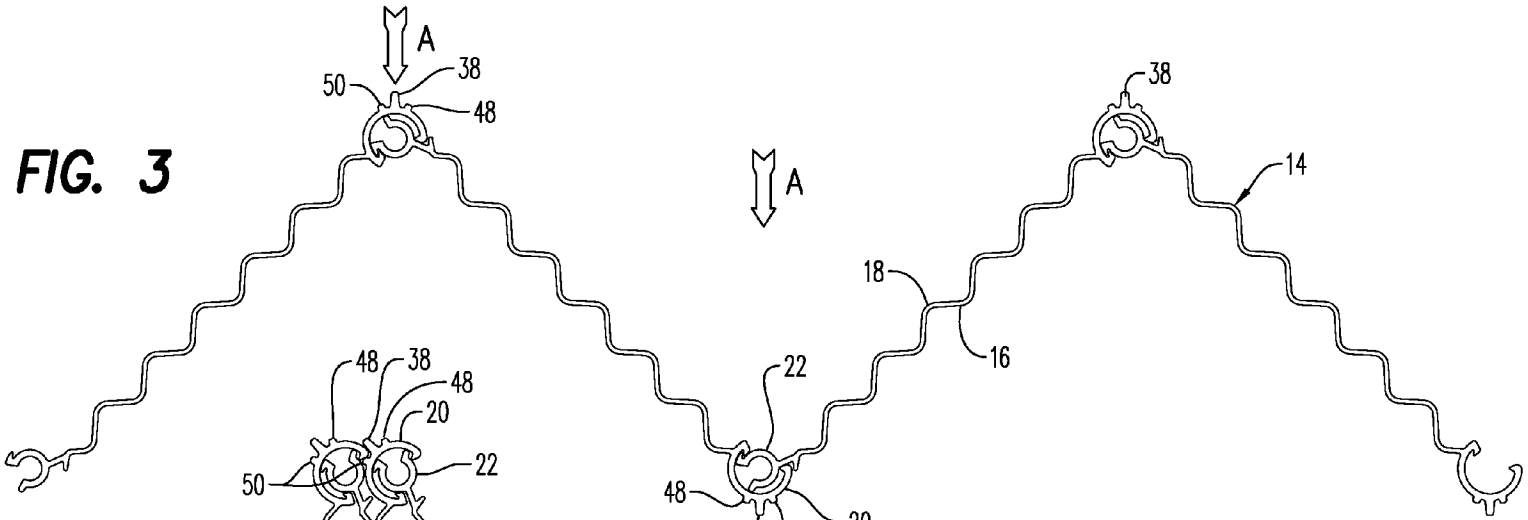
FIG. 3 is a top plan view of FIG. 2.
Figure 4:
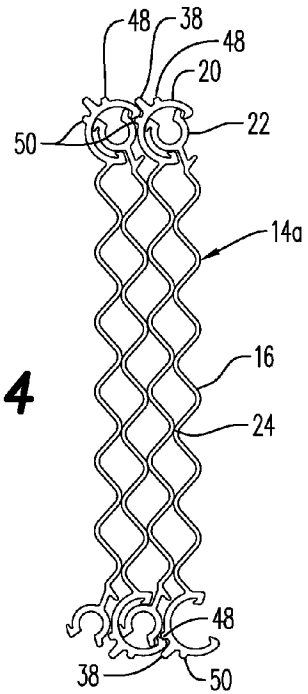
FIG. 4 is a top plan view of FIG. 3 in the closed or stored orientation.
Figure 5A:
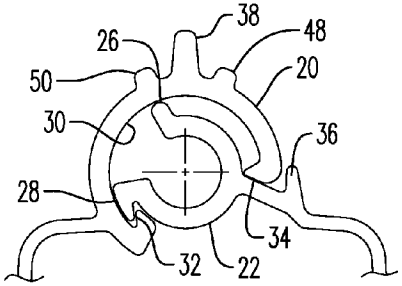
FIG. 5A is an enlarged top plan view of two pivotally connected adjacent shutters in the open position.
Figure 5B:
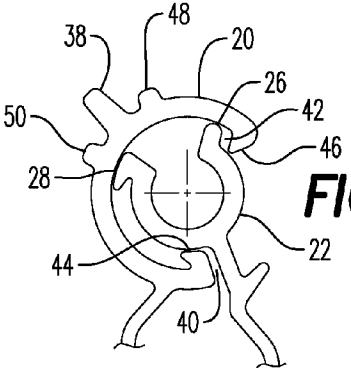
FIG. 5B is a view of FIG. 5 in the closed position.

Referring particularly to FIG. 3, wind and flying airborne objects may impact the outer surface of the storm slats 14 in the direction of arrow A. Airborne flying objects during hurricane force winds can exceed 100 mph, such flying objects as large timbers, pieces of concrete and the like and other heavy objects capable of inflicting severe damage to buildings and easily penetrating through glass windows and doors absent the protection afforded by the present invention. As should be now understood, the corrugations 18 add substantial strength and impact resistance afforded by each of the storm slats 16; moreover, the mating hinge edges 20 and 22 add substantial additional impact strength to the deployed storm shutter assembly 10.

The above described structure of the female and male hinge edges 20 and 22, respectively, server to both interconnect complementary edges of adjacent shutter slats 16, and also to provide for the pivotal deployment and closure of the storm shutter assembly 10 as shown in FIGS. 3, 4, 5A and 5B. In the open or deployed position shown in FIG. 3 and in FIG. 5A, adjacent storm slats 16 are opened into a orthogonal relationship one to the next wherein male tab 28 makes contact at open stop surface 32 while female tab 46 makes contact at open stop surface 34. When the plurality of storm slats 14 are in the closed portion shown in FIG. 4 and in FIG. 5V, male tab 26 makes contact at closed stop surface 42 against female tab 46, while female tab 44 makes contact at closed stop surface 40.

One aspect of this invention resides in the addition of the corrugations or zigzag strengthening waves extending in spaced relationship across the width of, and coextensive with, each of the storm slats 16. By the addition of these corrugations, substantial stiffness, rigidity and impact strength resistance are added to the storm shutter assembly 10 to greatly enhance the ability of the storm shutter assembly 10 to resist penetration of flying objects produced during hurricane force winds, and also to greatly enhance the ability of such a storm shutter assembly to withstand the rigors of building code storm testing which emphasizes impact against the weak points of each shutter assembly being tested.

Figure 6:
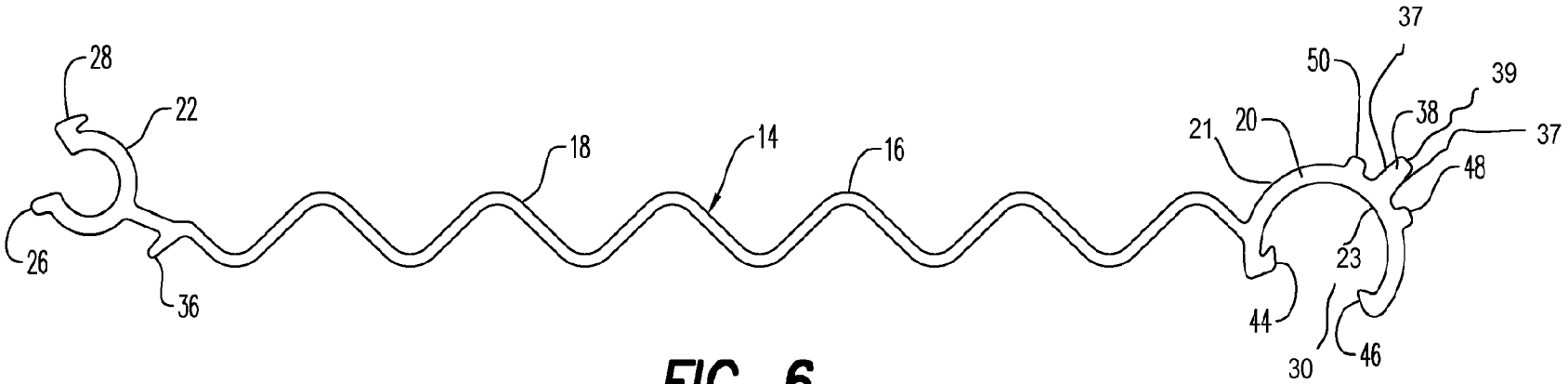
FIG. 6 is a top plan view of one of the shutters of FIG. 1 or 2.

A primary aspect of added impact strength of this invention resides in the addition of spaced strengthening ribs 38, 48 and 50 which extend outwardly from the female hinge edge 20 and longitudinally along the length thereof. As seen in FIG. 3, the larger central rib 38 is oriented directly outwardly direction into the anticipated path A of airborne flying objects which may strike the hinge edge 20. The smaller reinforcing ribs 48 and 50 add overall impact strength to the hinges and will withstand oblique impact strikes. With reference to FIG. 6, each of the ribs 38, 48, and 50 are formed of a pair of side walls 37 and a distal wall 39 extending between the pair of side walls 37. The central reinforcing rib 38 has a thickness that is greater than the thickness of the female hinge edge 20 between an exterior surface 21 and an opposite interior surface 23. The thickness of the central reinforcing rib 38 extends between the exterior surface 21 of the female hinge edge 20 and the distal wall 39.

Figure 7:
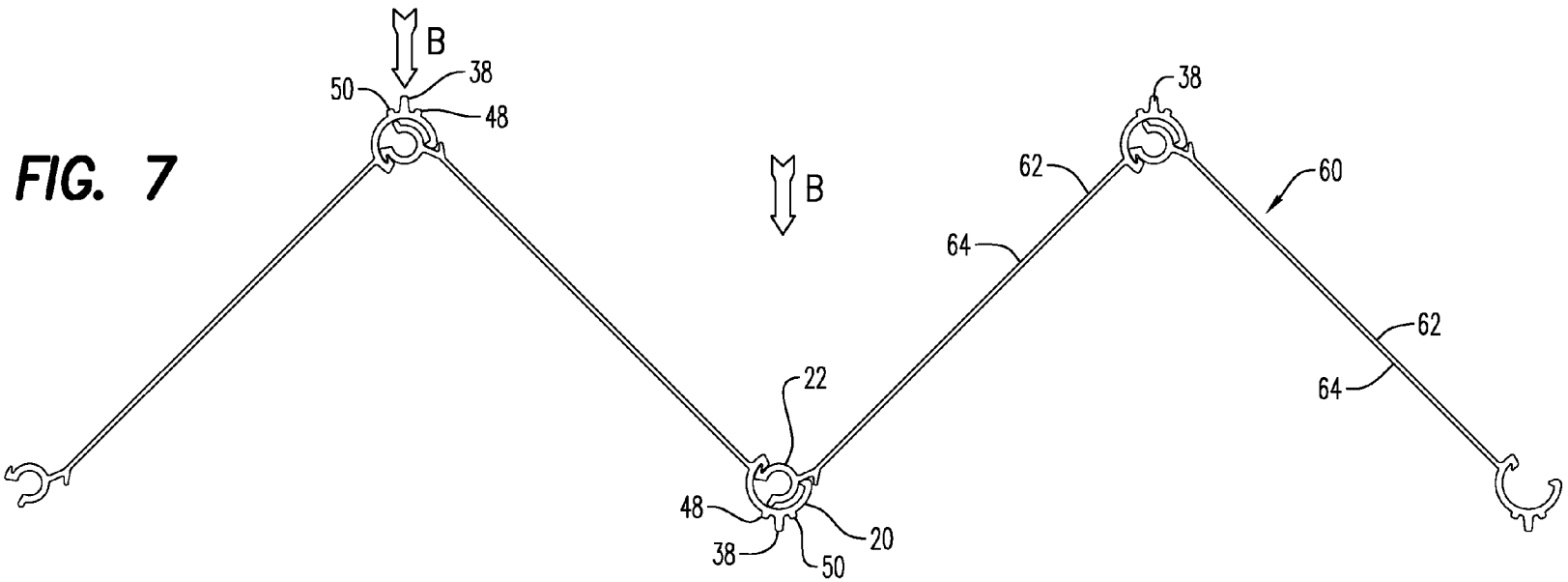
FIG. 7 is a top plan view similar to FIG. 3 showing a flat shutter slat embodiment of the invention.
Figure 8:
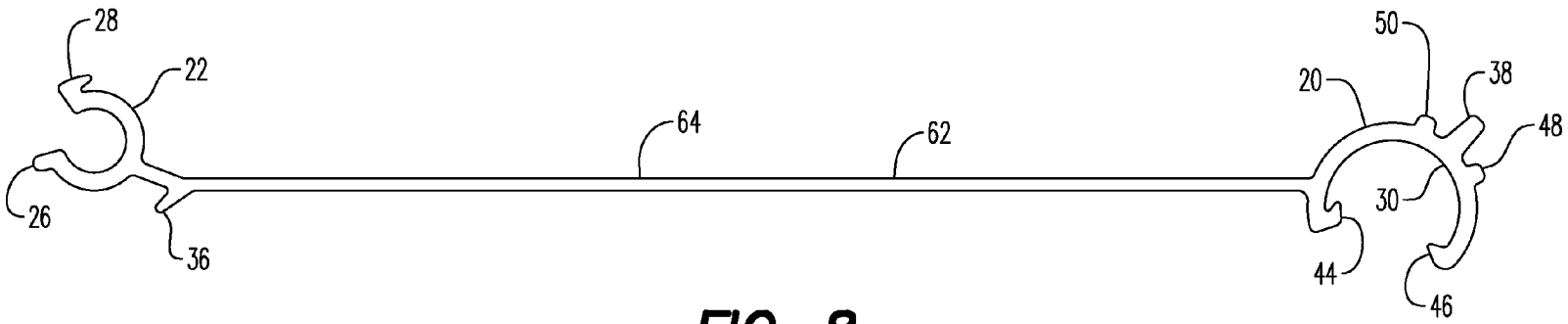
FIG. 8 is a top plan view of one of the shutters of FIG. 7.

In FIGS. 7 and 8, this hingedly connected plurality of storm slats 60 includes individual storm slats 62 having hinge edges 20 and 22 as previously described. However, each of these storm slats 62 have flat central panels 64 and depend only upon the reinforcing ribs 38, 48 and 50 located on the outer surface of each of the female hinge edges 20 as previously described.

The present invention thus achieves the dual purposes of building code hurricane testing standards being met and enhanced security against flying object impact against penetration through the windows and doors and into a building or home.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. An accordion shutter assembly for protecting an opening of a building, said shutter assembly comprising:

a plurality of elongated vertically extending shutter slats;

each of said slats having a male hinge on one side of said slat and a female hinge on an opposite side of said slat, said male hinge and said female hinge configured for hingedly connecting said slats together for limited pivotal movement between adjacent said slats to form said shutter assembly, said shutter assembly moveable between an open position and a closed position;

said female hinge of each of said slats having a reinforcing rib extending outwardly from an exterior surface of said female hinge, said reinforcing rib having a pair of side walls and a distal end extending between said pair of side walls, said reinforcing rib having a thickness that extends between said exterior surface of said female hinge half and said distal end that is greater than a thickness between the exterior surface and an opposite interior surface of the female hinge;

each of said reinforcing rib extending in a direction generally normal to the opening of the building when said shutter assembly is in said open position so as to define an outwardly most extending portion of said shutter slats to increase the impact resistance of said shutter assembly.

2. The accordion shutter assembly of claim 1, wherein said reinforcing rib substantially extends the length of said female hinge.

3. The accordion shutter assembly of claim 2, wherein said reinforcing rib extends continuously along the entire length of said female hinge.

4. The accordion shutter assembly of claim 1, wherein said female hinge includes a plurality of spaced apart reinforcing ribs extending outwardly from said exterior surface of said female hinge.

5. The accordion shutter assembly of claim 4, wherein said plurality of spaced apart reinforcing ribs includes a central reinforcing rib positioned between a pair of flanking reinforcing ribs, and wherein said central reinforcing rib extends beyond said pair of flanking reinforcing ribs in an outwardly direction from said exterior surface of said female hinge.

6. The accordion shutter assembly of claim 1, wherein each of said slats includes a corrugated central portion extending between said one side and said other side of said slat, said corrugated central portion increases the impact resistance of said shutter assembly.

* * * * *